US007958937B1

(12) United States Patent
Hemenway

(10) Patent No.: US 7,958,937 B1
(45) Date of Patent: Jun. 14, 2011

(54) PROCESS FOR HYDROFRACTURING AN UNDERGROUND AQUIFER FROM A WATER WELL BOREHOLE FOR INCREASING WATER FLOW PRODUCTION FROM DENVER BASIN AQUIFERS

(75) Inventor: Courtney Hemenway, Parker, CO (US)

(73) Assignee: Well Enhancement & Recovery Systems, LLC, Denver, CO (US)

( * ) Notice: Subject to any disclaimer, the term of this patent is extended or adjusted under 35 U.S.C. 154(b) by 247 days.

(21) Appl. No.: 12/315,640

(22) Filed: Dec. 5, 2008

Related U.S. Application Data

(63) Continuation-in-part of application No. 11/880,857, filed on Jul. 23, 2007, now Pat. No. 7,546,877.

(51) Int. Cl.
*E21B 43/267* (2006.01)
*E21B 43/04* (2006.01)
*E21B 47/00* (2006.01)

(52) U.S. Cl. ..... 166/308.1; 166/254.2; 166/278

(58) Field of Classification Search ..... 166/254.2, 166/308.1, 308.2, 278
See application file for complete search history.

(56) References Cited

U.S. PATENT DOCUMENTS

| | | | | | |
|---|---|---|---|---|---|
| 2,978,024 | A * | 4/1961 | Davis | 166/278 |
| 3,020,954 | A * | 2/1962 | Graham et al. | 166/281 |
| 3,602,308 | A * | 8/1971 | Vincent | 166/281 |
| 4,078,609 | A * | 3/1978 | Pavlich | 166/271 |
| 4,353,249 | A * | 10/1982 | Lagus et al. | 73/152.41 |
| 4,442,895 | A * | 4/1984 | Lagus et al. | 166/250.1 |
| 4,463,810 | A * | 8/1984 | Hill | 166/308.5 |
| 4,474,409 | A * | 10/1984 | Trevits et al. | 299/16 |
| 4,705,113 | A * | 11/1987 | Perkins | 166/302 |
| 4,714,115 | A * | 12/1987 | Uhri | 166/308.1 |
| 4,800,753 | A * | 1/1989 | Despax et al. | 73/152.39 |
| 5,036,919 | A * | 8/1991 | Thomas et al. | 166/271 |
| 5,435,391 | A * | 7/1995 | Jones | 166/308.1 |
| 5,472,049 | A * | 12/1995 | Chaffee et al. | 166/250.1 |
| 5,499,678 | A * | 3/1996 | Surjaatmadja et al. | 166/298 |
| 5,765,642 | A * | 6/1998 | Surjaatmadja | 166/297 |
| 6,192,985 | B1 * | 2/2001 | Hinkel et al. | 166/280.1 |
| 6,446,727 | B1 * | 9/2002 | Zemlak et al. | 166/308.1 |
| 6,846,130 | B2 * | 1/2005 | Goughnour | 405/50 |
| 7,243,723 | B2 * | 7/2007 | Surjaatmadja et al. | 166/278 |
| 7,486,589 | B2 * | 2/2009 | Lee et al. | 367/35 |
| 7,546,877 | B1 * | 6/2009 | Hemenway | 166/308.1 |
| 7,681,654 | B1 * | 3/2010 | Cugnet | 166/387 |
| 2003/0075333 | A1 * | 4/2003 | Vercaemer et al. | 166/308 |
| 2003/0106690 | A1 * | 6/2003 | Boney et al. | 166/280 |
| 2005/0279501 | A1 * | 12/2005 | Surjaatmadja et al. | 166/278 |
| 2008/0210422 | A1 * | 9/2008 | Clark et al. | 166/254.2 |
| 2008/0264640 | A1 * | 10/2008 | Eslinger | 166/308.1 |

* cited by examiner

*Primary Examiner* — Jennifer H Gray
(74) *Attorney, Agent, or Firm* — Edwin H. Crabtree; Ramon L. Pizarro

(57) ABSTRACT

A process for hydrofracturing a specific interval or zone in a water aquifer from a water well borehole and introducing high-pressure water and gravel proppants for increasing water flow production from the water well. The process uses a hydrofracture tool having a pipe section with a pair of inflatable packers. The tool is lowered into the borehole to the deepest interval to be fraced. The packers are then inflated thus sealing off the area in the borehole above the interval. High-pressure water is then introduced through the drill stem and out a high-pressure injection port in the lower end of the pipe section. After sufficient high-pressure water has fractured the surrounding interval, gravel proppants are forced into the surrounding fractured interval.

11 Claims, 6 Drawing Sheets

PROCESS FOR HYDROFRACTURING AN UNDERGROUND AQUIFER FROM A WATER WELL BOREHOLE FOR INCREASING WATER FLOW PRODUCTION FROM DENVER BASIN AQUIFERS

This application is a continuation-in-part patent application claiming the benefit and priority date of an earlier filed patent application Ser. No. 11/880,857, filed on Jul. 23, 2007, now U.S. Pat. No. 7,546,877 by the subject inventor.

BACKGROUND OF THE INVENTION (a) Field of the Invention

This invention relates to the hydrofracturing of an underground aquifer from a water well borehole and more particularly, but not by way of limitation, to hydrofracturing a specific interval or zone in an aquifer from the water well borehole and introducing gravel proppants under pressure for increasing water flow production from the water well.

(b) Discussion of Prior Art

Along the front range of the Rocky Mountains in Colorado, the Denver Basin aquifers are a major source of water supply for the Denver metropolitan area. As the cost of drilling and equipping water wells increases, combined with the naturally low transmissive water-bearing materials of these aquifers, new methods for increasing the production of well yields and extending the sustainable life of water wells need to be developed. Each of the Denver Basin aquifers is comprised of several sandstone and siltstone layers. Within each of the aquifers, these water-bearing intervals vary in thickness, hydraulic conductivity, storage coefficients and yield. Therefore, to enhance or stimulate additional production or yield from any of the aquifers is difficult due to the characteristics of the individual aquifers.

Heretofore, most attempts to increase low yields and mitigate the sustainability problems have been focused on wellhead treatments subsequent to drilling and equipping the well. Mechanical and chemical treatments have been used to increase the efficiency of the well and rehabilitate the aquifer at or in the immediate area, less than a few feet, of the well borehole annulus. While these treatments have variable results, sometimes increasing the well production by a certain percentage, typically less than a 50% increase from the current well production, the improvements typically are temporary with well yields decreasing over time to at or below the original yields determined after the initial completion of the well.

Recent attempts to increase yields and improve sustainability in water wells on a long-term basis have employed oil field technologies. These attempts involved directional drilling techniques and completions, as well as well bore hydrofracturing. Two wells in the Denver Basin have employed directional drilling techniques to enhance the well production. Both have showed limited, if any, success. The cost/benefit ratios using directional drilling techniques have not been favorable. One well showed only marginal production results, while costs of the well completion were two to three times the normal cost for a standard vertical well completion. The second directionally-drilled well in the Denver Basin involved the drilling of one vertical well and a second directionally-drilled well to intercept the first vertical well. Due to several technical problems, the directionally-drilled well was abandoned and the vertical well, although damaged due to the attempted dual-well completion technique, produced lower than anticipated yields. The cost of the second directionally-drilled well was three to five times the normal well completion costs for a standard vertically-completed well.

In addition to the above-mentioned directionally-drilled wells, one deep Denver Basin well was recently hydrofractured using modified oil field techniques by the inventor of the subject process described herein. The hydrofracturing was completed in one operation over an entire length of an aquifer formation, which included several non-saturated intervals. The success of this fracing process was limited due to the inability to control the process over certain specific saturated water-producing intervals. While this process increased the initial production characteristics of the well, when the water that was injected into the well during the fracturing process was pumped out of the well, the long-term well yield was not increased.

None of the above-mentioned attempts to improve and increase water well production in an underground aquifer provide the unique steps described herein for hydrofracing a specific interval using high water pressure with gravel proppants for increased water production for long-term well yield.

SUMMARY OF THE INVENTION

In view of the foregoing, it is a primary objective of the subject invention to provide a vastly improved process over directionally-drilled methods of water well enhancement in both cost of implementation and benefits, i.e., increased well yield and long-term sustainability.

Another object of the invention is that the process is focused on hydrofracturing individually one or more specific intervals within a well borehole and using a specialized hydrofracture tool. This feature is unlike prior hydrofracturing processes in the Denver Basin aquifer, when the process involved fracing an entire length of the aquifer system with limited success and increased cost.

Still another object of the hydrofracturing process is the water well can be drilled and completed with little modification to normal drilling and well completion techniques. In prior attempts to hydrofracture a Denver Basin aquifer system, surface casing of sufficient diameter to allow for the fracing process was placed to a depth immediately above the aquifer to be hydrofractured. This technique modified the normal well drilling and completion operations from a standard vertical water supply well and significantly increased the final costs of the well.

Yet another object of the process and using the specialized hydrofracture tool, undesirable zones within the well borehole can be bypassed and only the intervals with potential increased well yields can be improved by fracing.

The subject hydrofracturing process includes drilling a normal vertical well into a selected Denver Basin aquifer using standard drilling methods. When the total depth, from a few hundred feet up to two to three thousand feet, is reached, borehole mud in the well is conditioned and the drill stem, collar, drill bit and related equipment used to drill the borehole is removed. In Colorado, the total depth of the well is determined by a Colorado State Engineer's Well Permit and actual site conditions. The well permit allows for the completing of the well to one specific aquifer.

After the drilling equipment is removed, the newly completed well is geophysically logged. The well log typically includes natural gamma ray, shallow and deep resistivity, induction, spontaneous potential and caliper. Also, compensated density and porosity logs can be run to further identify the hydraulic characteristics of the water-bearing intervals of interest. Following the geophysical logging of the borehole, the borehole cuttings and the geophysical logs are compared and analyzed to determine the selected water-bearing intervals to be hydrofractured using the subject process and tool.

The specialized hydrofracture tool, with a pair of inflatable packers, is attached to the bottom of a drill stem and lowered into the borehole to the deepest interval to be fraced. The packers are then inflated through nylon or stainless steel tubing connected to the ground surface thus sealing off the area in the borehole above the interval. High-pressure water is now introduced through the drill stem, through a pipe section and out an injection port in the lower end of the pipe section and into the surrounding water-bearing materials of the selected interval. After sufficient high-pressure water has fractured the surrounding interval, gravel proppants are introduced into the high pressure, water injection stream and forced into the surrounding fractured interval. The water injection stream with proppants is terminated based on the pressure and flow characteristics that indicate there is no longer any additional fracturing or propping of the fracture paths in the interval.

Upon discontinuing the hydrofracturing of the interval, the two packers are deflated and the hydrofracture tool is moved upwardly in the borehole to the next water-bearing interval and the process is repeated as described above. Depending on the number of intervals in the borehole to be treated, the process is repeated until the last and upper interval is fraced and proppants introduced therein. The tool with packers is then removed from the borehole using the drill rig and drill stem assembly. Following the removal of the tool, the drill stem and bit are used to drill out and clean the well bore area of the proppants to allow for normal installation of the casing and screens. The well is now completed using normal well completion techniques by installing casing with a water screen string in the borehole followed by normal gravel packing and grouting operations.

These and other objects of the present invention will become apparent to those familiar with different processes related to hydrofracturing of underground aquifers when reviewing the following detailed description, showing novel construction, process steps, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the subject hydrofracturing process and in which.

DETAILED DESCRIPTION OF THE PREFERRED EMBODIMENTS

Figure 1:
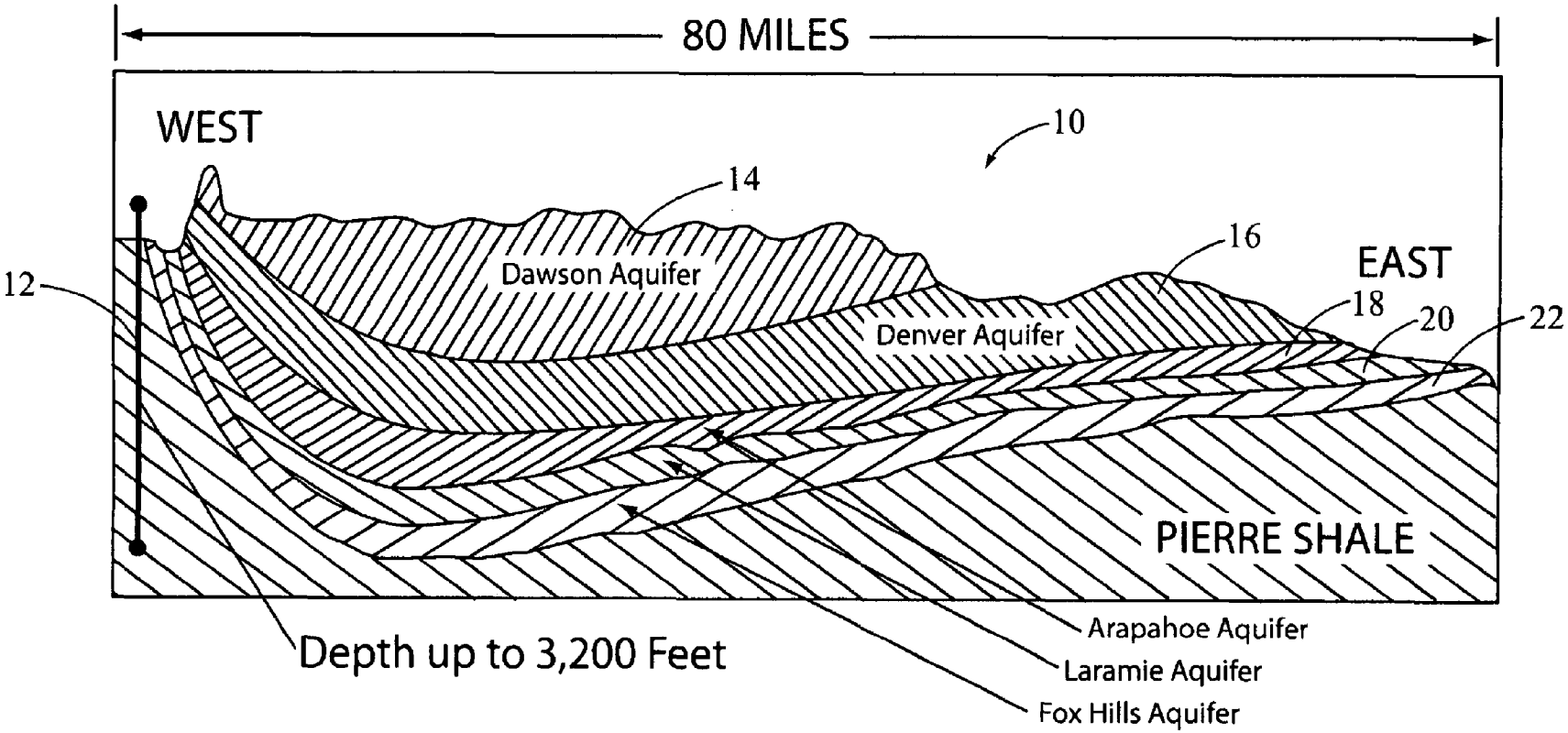
FIG. 1 is an 80-mile, east to west, cross section of the Denver Basin aquifers running along the front range of the Rocky Mountains in Colorado. The front range runs north and south. The depth of the aquifers is down to 3000 feet and greater.

In FIG. 1, an 80-mile, east to west, cross section of the Denver Basin aquifers is illustrated running from the front range of the Rocky Mountains to the eastern plains of Colorado. The Denver Basin is shown having a general reference numeral 10. The depth of the aquifers is down to 3000 feet and greater. This depth is indicated by a vertical column 12 shown in the drawings. The Denver Basin 10 includes the Dawson aquifer 14, the Denver aquifer 16, the Arapahoe aquifer 18, the Laramie aquifer 20 and the Fox Hills aquifer 22. While the Denver Basin 10 is discussed herein, it should be mentioned that the subject aquifer hydrofracturing process can certainly be used equally well in other aquifer systems in this and other countries. Obviously depending on the water well site, the depth of a well will vary from location to location and from a few hundred feet to over 2000 to 3000 feet in depth. Also, water well production can vary from 50 to 200 gallons per minute up to over 1500 gallons per minute. As mentioned above, each aquifer includes a number of water-bearing intervals 24 or zones disposed between non-water-bearing intervals 25. An example of the intervals 24 and 25 is shown in FIGS. 2-6.

Figure 2:
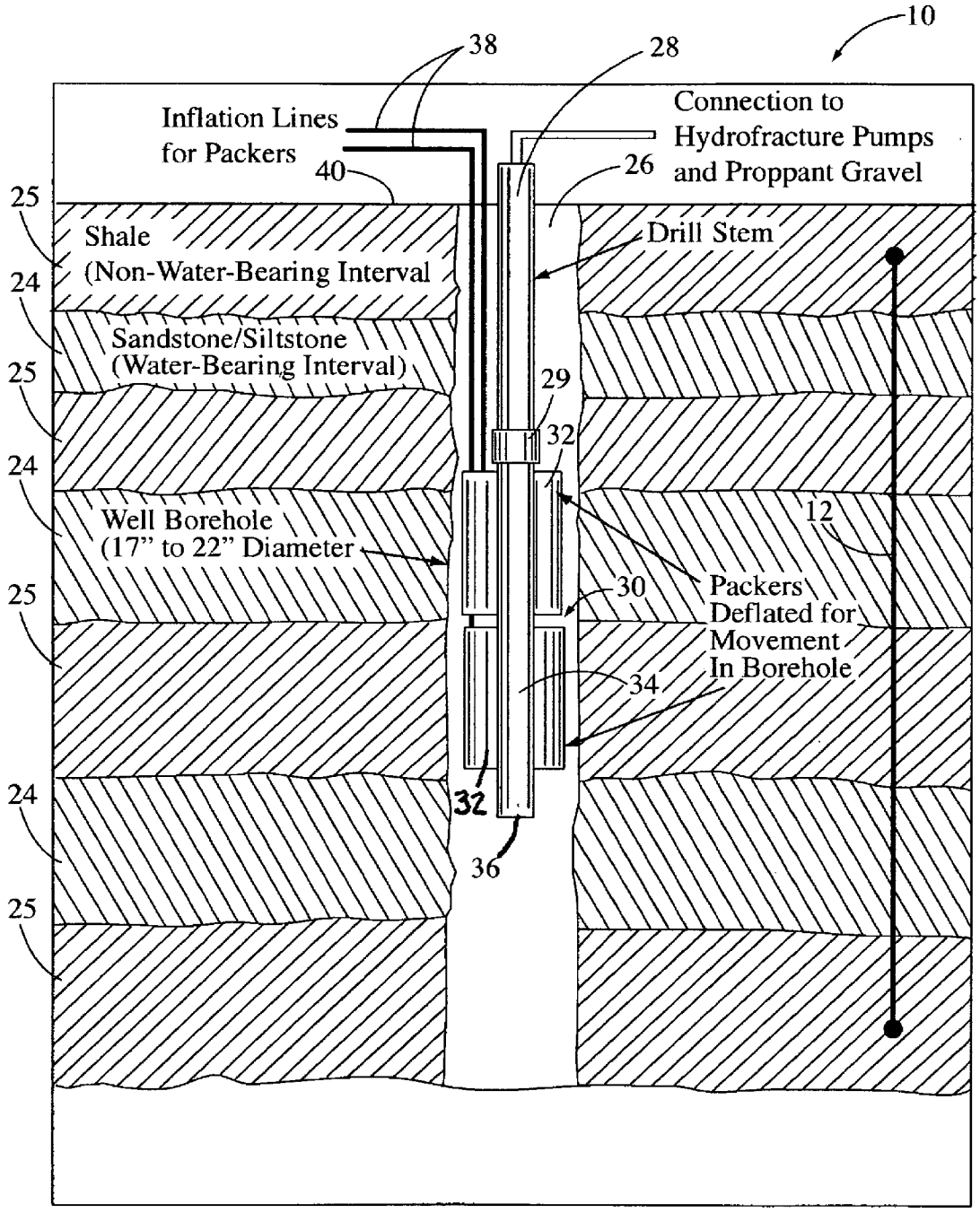
FIG. 2 is a vertical cross-section of a water well borehole drilled into a selected aquifer, as shown in FIG. 1. The drawing is not to scale and illustrates a drill stem with collar connected to a hydrofracture tool. The tool includes a pair of packers disposed next to each other on a pipe section. The pipe section is positioned in the borehole and just above a lower water-bearing interval to be fractured.

In FIG. 2, a vertical cross-section of a water well borehole 26 is shown drilled into a selected aquifer, for example, the Arapahoe aquifer 18 shown in FIG. 1. The drawing of the borehole 26 in relationship to the intervals 24 and 25 is not to scale. In this drawing, a drill stem 28 with a collar 29 is connected to a specialized hydrofracture tool. The tool is shown having general reference numeral 30. The tool 30 includes a pair of inflatable packers 32 mounted on a pipe section 34. The pipe section 34 includes a lower end used as a high pressure injection port 36. The injection port 36 is used to introduce a high-pressure stream of water from the drill stem 28, through the pipe section 34, and into a selected water-bearing interval 24. In this drawing, the injection port 36 is positioned in the borehole 26 just above the lowest interval 24 to be fraced. The water-bearing interval 24 can vary in width, typically from 10 to 40 feet or greater.

As mentioned above, the subject hydrofracturing process includes drilling a normal vertical well, such as the water well borehole 26 into the selected aquifer in the Denver Basin 10 and using standard drilling methods. When the total depth, from a few hundred feet up to 2000 to 3000 feet, is reached, borehole mud in the well borehole 26 is conditioned and the drill stem 28 with collars, drill bit and related equipment are removed from the well.

After the drilling equipment is removed, the well borehole 26 is geophysically logged. The well log includes natural gamma ray, shallow and deep resistivity, induction, spontaneous potential and caliper. Also, compensated density and porosity logs can be run to further identify the hydraulic characteristics of the water-bearing intervals 24. Following the geophysical logging of the borehole 26, the borehole cuttings and the geophysical logs are compared and analyzed to determine the selected water-bearing intervals to be hydrofractured using the subject process and the hydrofracture tool 30. At this time, the hydrofracture tool 30 is attached to the bottom of the drill stem 28 with the inflatable packers deflated. The tool 30 is then lowered into the borehole 26 to a deepest interval to be fraced, as shown in this drawing. It should be mentioned that the subject process for hydrofracturing an underground aquifer can be used not only for a newly-drilled water well but can also be used equally well for producing water wells currently in operation. But, with existing wells, a new tool would be required to cut and repair the screens in the well before and after hydrofracturing was initiated in the well bore.

Figure 3:
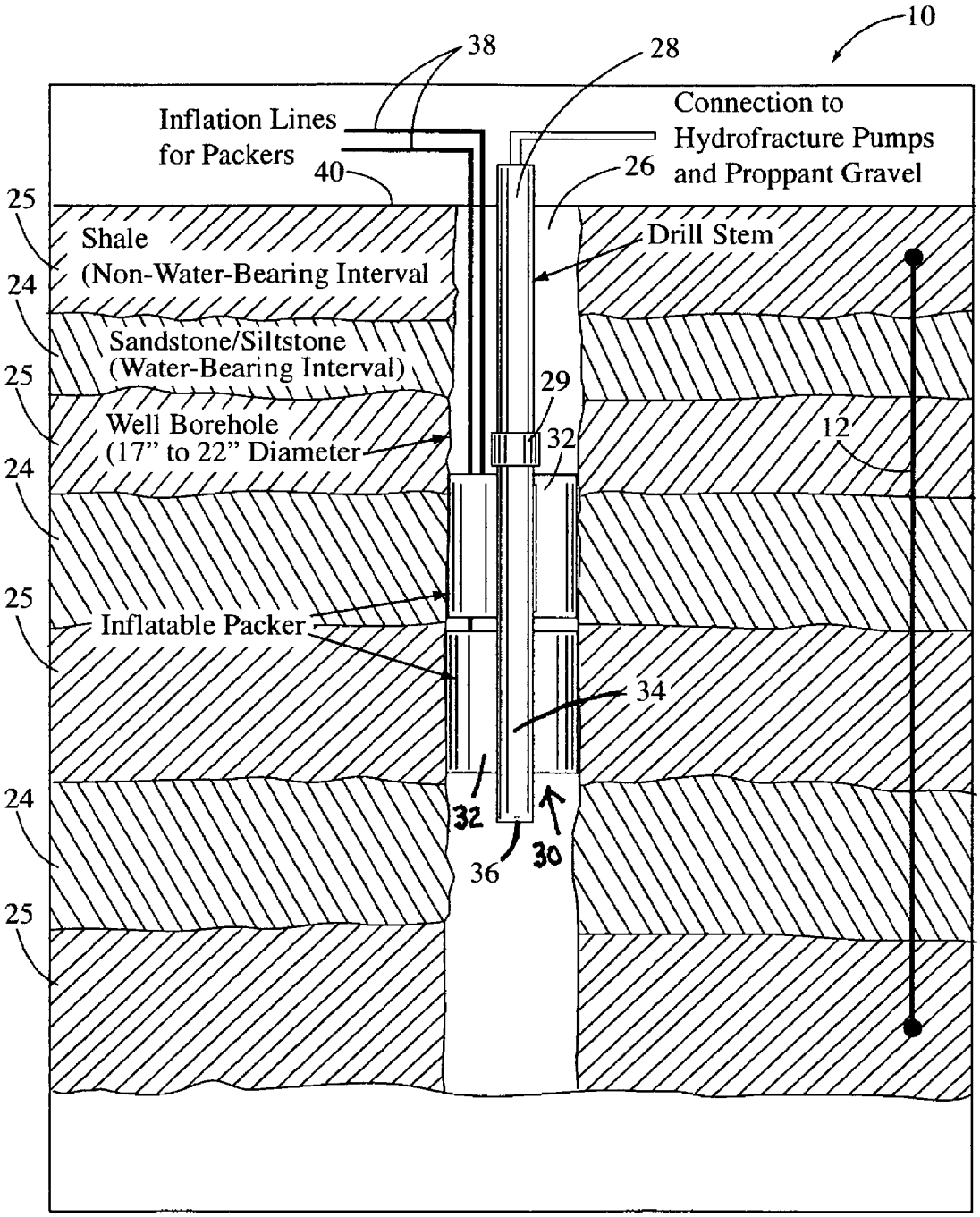
FIG. 3 illustrates the borehole shown in FIG. 2 and with the packers inflated on the tool and against the side of the borehole prior to fracing the water-bearing interval with high-pressure water.

In FIG. 3, the packers 32 are inflated using nylon or stainless steel tubing 38. The tubing 38 is connected to a fluid pressure source on a ground surface 40. The fluid pressure source is not shown in the drawings. With the packers 32 inflated around the pipe section 34 and against the side of the borehole 26, the area around the borehole next to the lowest interval 24 is ready for hydrofracturing. Typically, the inside diameter of the pipe section is approximately 6 inches. The outside diameter of the uninflated packers is approximately 15.5 inches. The packers 32 typically can be inflated in a range of 17 to 22 inches, with a maximum recommended borehole diameter in a range of 17 to 22 inches. The two packers 32 are used to seal the borehole above the interval 24 to be fraced and prevent a blowout and pressure loss during the fracing process.

Figure 4:
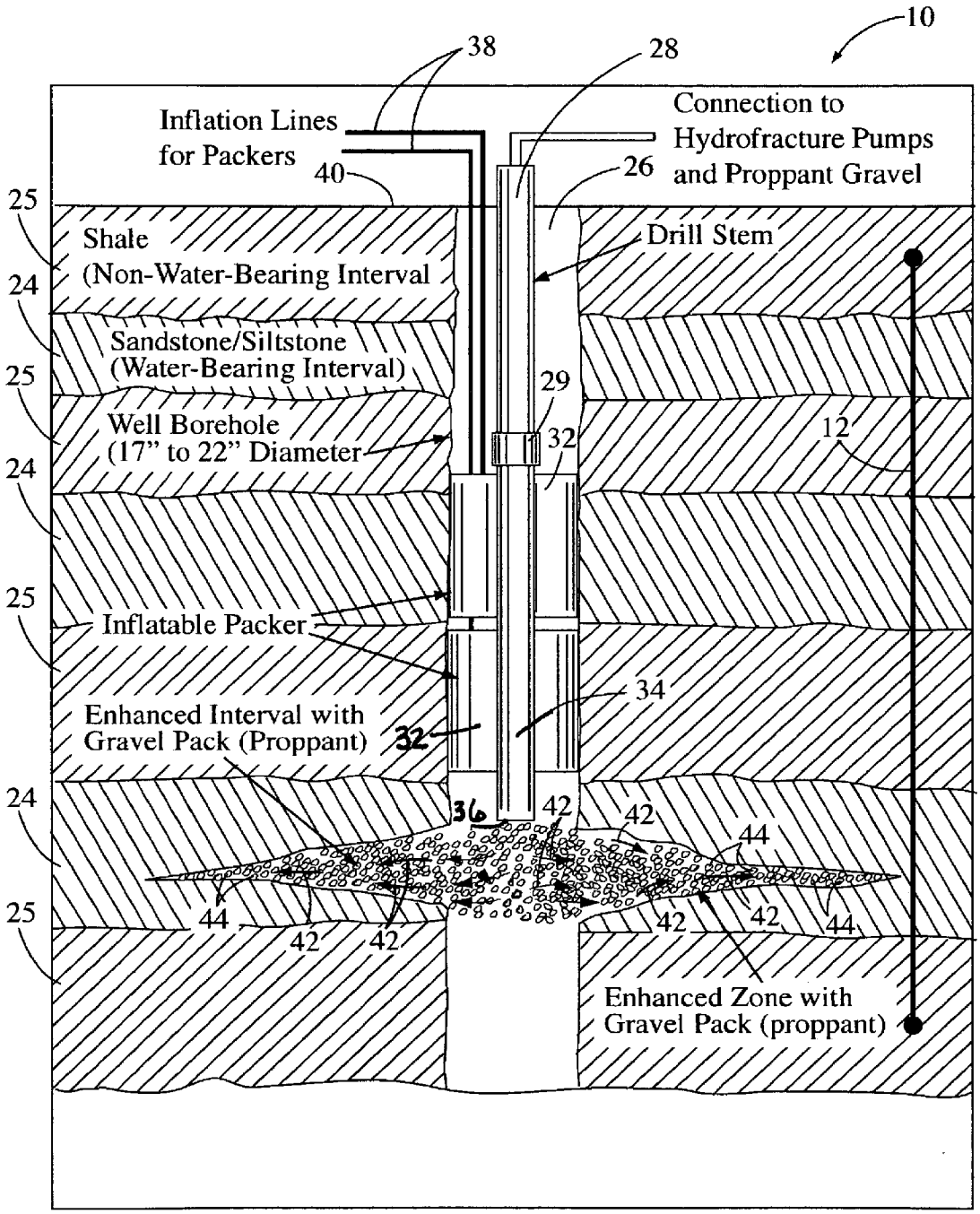
FIG. 4 illustrates the introduction of high-pressure water and gravel proppants into the fractured water-bearing interval.

In FIG. 4, water under high-pressure water, indicated by arrows 42, is now introduced through the top of the drill stem 28 using high-pressure pumps and tanks disposed on the ground surface 40. This equipment is not shown in the drawings. The high-pressure water 42, typically in a range of 300 to 1000 psi and greater, is circulated out the high pressure injection port 36 and into the surrounding water-bearing interval 24. After sufficient high-pressure water has fractured the surrounding interval, gravel proppants 44 are introduced slowly into the high-pressure water 42 and forced into the surrounding fractured interval 24, as shown in this drawing. The high-pressure water stream with the proppants 44 is terminated based on increased pressure and reduced flow characteristics that indicate there is no longer any additional fracturing or propping of the fracture paths in the interval 24. In this drawing, the high-pressure water 42 is introduced into the borehole 26 into the interval 24 in a 360 degree circular path from the injection port 36.

It is noteworthy to mention that the selection of proppant size is important and typical gravel pack size is 12-20 mesh size gradation. But, certain aquifers have a larger sand grain size and therefore a larger proppant size is required to hold the fractured interval open and enhance the water flow of the well. The larger proppant size is typically 8-12 mesh size gradation. When using the larger proppant 8-12 mesh size gradation, the fracing fluid requires the addition of a polymer to increase the viscosity of the fluid and carry the larger grains in suspension and into the fractures in the interval 24. The polymer can be a polyacrylomide polymer or a polymer with similar chemical makeup. Obviously, the addition of the polymer adds to the cost of the frac fluid and the smaller proppant grain size is used when it's sufficient to keep the fractured interval open for increased water flow. When introducing the larger proppant size and following the addition of the proppant, the fractures are flushed with a highly-chlorinated water to break down the polymers used during the injection and placement of the proppants. The introduction of the chlorinated water reduces the viscosity of the frac fluid circulated in the fractured interval and thus enhances the water flow therefrom.

This type of hydrofracturing of one or more intervals 24, as shown in the drawings, appears to take on a horizontal pancake type fracture pattern. Obviously, the high-pressure water 42 will follow a path of least resistance in the interval 24. In this example, the fracing of a substantially horizontal sandstone/siltstone water-bearing formation in the Denver Basin 10 would appear to occur outwardly and horizontally as opposed to creating vertical fractures in the interval. But, the fracing could also occur outwardly and both horizontally and vertically in the interval.

Figure 5:
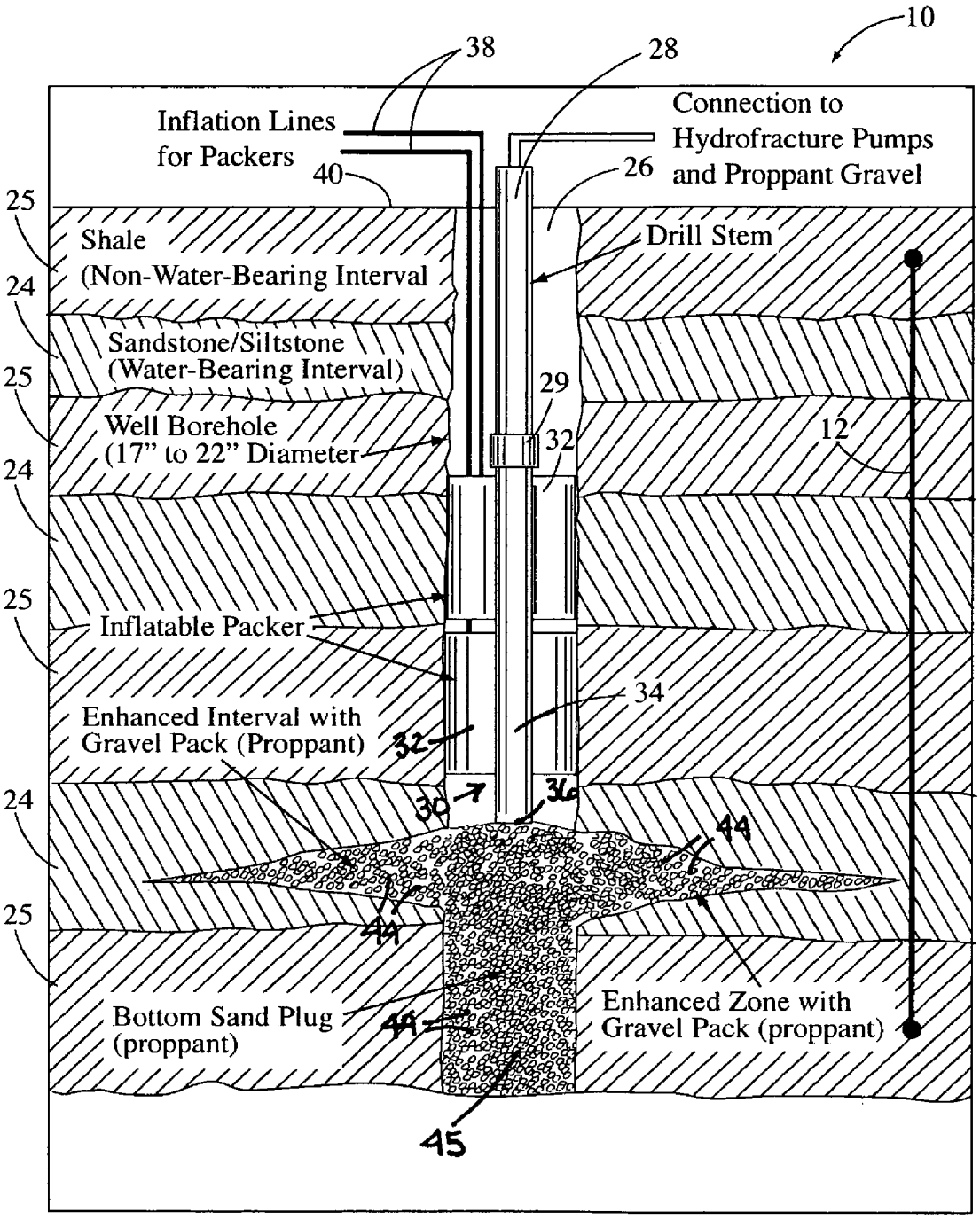
FIG. 5 illustrates the gravel proppants disposed in the enhanced, fractured water-bearing interval and proppants having filed the bottom of the borehole and forming a bottom sand plug.

In FIG. 5, the gravel proppants are illustrated disposed in the enhanced, fractured water-bearing interval 24 for increased water flow from the borehole. Also, the proppants are shown having filled the bottom of the borehole 26 for forming a bottom sand plug 45.

Upon discontinuing the hydrofracturing of the lowest interval, the two packers 32 are deflated and the hydrofracture tool 30 is moved upwardly in the borehole 26 to the next water-bearing interval 24 and the process is repeated as described above. The hydrofracturing of the next to lowest interval 24 is not shown in the drawings. Depending on the number of intervals 24 in the borehole 26 to be treated, the process is repeated until the last and upper interval is fraced and proppants introduced therein.

Figure 6:
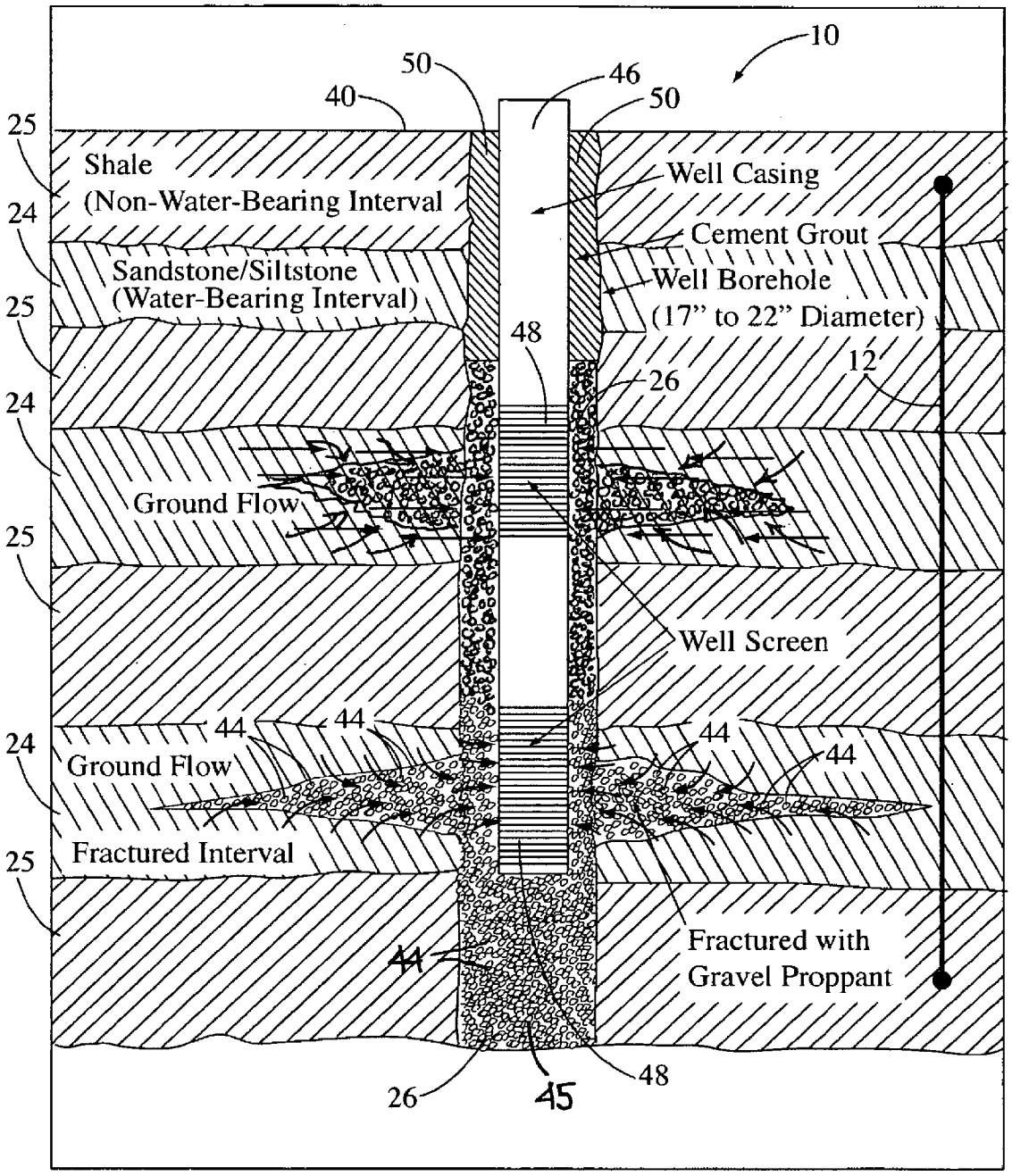
FIG. 6 illustrates the borehole with the completion of the hydrofracturing process and with water flowing through well screens on a well casing.

In FIG. 6, the specialized hydrofracture tool 30 with pipe section 34 and packers 32 are shown removed from the borehole 26 using a drill rig with connected drill stem 28. Following the removal of the tool, the drill stem and bit are used to drill out and clean the well of the proppant to allow for the normal installation of the casing and screens. The water well borehole 26 is now completed using normal well completion techniques by installing a well casing 46 with water screens 48 followed by normal gravel packing and cement grout 50 disposed around the top of the well casing 46. The water screens 48 on the well casing 46 are disposed in the borehole 26 next to the water-bearing intervals 24.

By following the above steps of the subject hydrofracturing process, the selective fracturing of a series of water-bearing intervals 24 with proppants 44 received in the fractured zones, the production of water flow from the borehole 26 can increase from 2 to 5 times an anticipated water production from the aquifer and over an extended life of the well.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A process for hydrofracturing in an underground aquifer and using a water well borehole with a drill stem suspended therein, the steps comprising:

using well log data for selecting at least one water-bearing interval in the borehole and determining the depth of the interval and the approximate width of the interval, the well log data including geophysical logging of the borehole, the geophysical logging of the borehole including comparing the logging with borehole cuttings;

lowering a hydrofracture tool connected to the bottom of the drill stem, the tool including a pipe section with at least one inflatable packer mounted thereon, a lower end of the pipe section acting as a high pressure injection port;

positioning the injection port just above the interval to be fractured;

inflating the inflatable packer for sealing an area around the pipe section and the borehole next to the pipe section;

introducing high-pressure water through the drill stem and out the bottom of the injection port in the pipe section for fracturing the interval;

introducing gravel proppants into the high-pressure water and forcing the proppants into the fractured interval;

terminating the high-pressure water and gravel proppants to the interval, deflating the inflatable packer and removing the tool from the borehole; and completing the water well using well casing and a water screen next to the fractured interval in the borehole.

2. The process as described in claim 1 further including a step of filing the bottom of the borehole with gravel proppants up to a depth of the fractured interval prior to the step of terminating the high-pressure water and gravel proppants to the interval.

3. The process as described in claim 1 wherein the gravel proppants have a 12-20 mesh size gradation.

4. The process as described in claim 3 further including a step of adding a polymer to the high-pressure water for suspending the 12-20 mesh size gradation gravel proppants when introducing the gravel proppants into the high-pressure water and forcing the proppants in the fractured interval.

5. The process as described in claim 4 wherein after the step of introducing the 12-20 mesh size gradation of gravel proppants into the high-pressure water and forcing the proppants into the fractured interval, introducing a chlorine flush into the high-pressure water.

6. The process as described in claim 1 wherein the high-pressure water is introduced into the drill stem at a pressure in a range of 300 to 1000 psi.

7. The process as described in claim 1 wherein the borehole has a diameter in a range of 17 to 22 inches.

8. The process as described in claim 1 wherein the step of using well log data includes selecting more than one water-bearing intervals in the borehole and determining the depth of the intervals and the approximate width of the intervals.

9. A process for hydrofracturing in an underground aquifer and using a water well borehole with a drill stem suspended therein, the steps comprising:

using geophysical well log data compared with borehole cuttings from the borehole for selecting first and second water-bearing intervals in the borehole and determining the depth of the intervals and the approximate width of each interval, the well log data including geophysical logging of the borehole;

lowering a hydrofracture tool connected to the bottom of the drill stem above a lowest, first interval in the borehole, the tool including a pipe section with a high-pressure injection port and a pair of inflatable packers mounted on the pipe section;

inflating the inflatable packers for sealing an area around the pipe section and the borehole next to the pipe section;

introducing high-pressure water with a polymer, the high-pressure water in a range of 300 to 1000 psi through the drill stem and out the injection port for fracturing the surrounding first interval;

introducing gravel proppants, having an 8-12 mesh size gradation slowly into the high-pressure water with the polymer and forcing the proppants into the fractured first interval, the polymer suspending the gravel proppants;

introducing a chlorine flush into the high-pressure water;

terminating the high-pressure water and gravel proppants to the fractured first interval when the pressure of the high-pressure water increases and the volume of water introduced in the first interval decreases;

deflating the inflatable packers and moving the tool upwardly in the borehole to the next lowest, second interval and positioning the pipe section above the second interval and repeating the introduction of high-pressure water and gravel proppants in the second interval;

terminating the high-pressure water and gravel proppants to the second interval when the pressure of the high-pressure water increases and the volume of water introduced in the second interval decreases; and completing the water well using well casing and water screens next to the fractured first and second intervals in the borehole.

10. The process as described in claim 9 wherein the geophysical logging of the borehole includes natural gamma ray testing, and shallow and deep resistivity testing, and induction testing, and spontaneous potential and caliper testing.

11. The process as described in claim 10 wherein the geophysical logging of the borehole further includes compensated density and porosity logs for identifying the hydraulic characteristics of the intervals.

* * * * *